United States Patent [19]

Malone

[11] Patent Number: 4,780,085

[45] Date of Patent: Oct. 25, 1988

[54] LAP TIMING DEVICE

[76] Inventor: Jerald C. Malone, 230 W. Hall, Suite 60, Slidell, La. 70460

[21] Appl. No.: 929,019

[22] Filed: Nov. 10, 1986

[51] Int. Cl.[4] ..... G04B 19/24

[52] U.S. Cl. ..... 434/254; 272/4; 272/71; 340/323 R

[58] Field of Search ..... 434/254; 272/71, 4; 368/10; 340/323 R

[56] References Cited

U.S. PATENT DOCUMENTS

| | | | |
|---|---|---|---|
| 3,678,496 | 7/1972 | Stalp | 340/323 R |
| 3,916,214 | 10/1975 | Coble, Jr. et al. | 340/323 R |
| 4,518,266 | 5/1985 | Dawley | 340/323 R |

*Primary Examiner*—Leo P. Picard
*Attorney, Agent, or Firm*—Keaty & Keaty

[57] ABSTRACT

A lap timing device for swimmers utilizes a proximity sensor to detect the completion of each lap a swimmer swims during a training session. The device, which is preferably portable and in the form of a starting block of standard AAU dimensions, is placed adjacent an edge of a swimming pool. The number of laps of the training session are input and the swimmer stands on the diving platform of the device. When the swimmer dives off of the platform, a switch starts a clock/counter in the device. The proximity sensor, preferably an ultrasonic transducer, detects the completion of each lap. When the predetermined number of laps is counted by the device, an alarm sounds, indicating to the swimmer the end of the training session, and the total swim time, average time per lap, fastest lap time and slowest lap time are displayed. The device automatically provides the pertinent information about a training session to the swimmer, allowing the swimmer to concentrate on his swimming without worrying about losing track of which lap he is on.

17 Claims, 4 Drawing Sheets

LAP TIMING DEVICE

BACKGROUND OF THE INVENTION

1. Field of the Invention

The present invention relates generally to timing aids for swimmers and, more specifically, to lap timing devices for swimmers.

2. General Background of the Invention

Swimming is a healthful form of exercise which enjoys popularity as a competitive sport. Various systems have been developed to aid in timing competitive swimmers. One type of system is an automatic judging system for swimming competitions which comprises automatic timers connected to pressure-sensitive touch pad switches disposed in a swimming pool. These systems, which are designed to eliminate human error from the judging process of swim races, usually also comprise a pressure-sensitive switch on a starting block, which switch serves to determine whether any competitor "jumps the gun".

U.S. Pat. No. 3,544,989 discloses such a system, in which a touch pad is disposed near each lane of a pool, and a pressure-sensitive switch is disposed on each starting block. Sound waves from a gun short start individual clocks for each competitor. As a competitor nears the end of his last lap of the race, his touch pad is lowered into the water in his lane. When he touches the pad, his relative position in the race and his total time for the race are recorded and displayed.

U.S. Pat. No. 3,916,214 discloses a similar system, basically differing from that of U.S. Pat. No. 3,544,989 in that the touch pads remain in the water throughout the race. A competitive swimmer touches the pad in his lane once per lap. The touch pad is connected to a counter and a timer. The counter counts the number of laps the swimmer has completed and, when the preset number of laps has been completed, the timer stops.

While the type of system disclosed in these two patents may be satisfactory in some respects, there are some inherent disadvantages. The touch pads must be constructed such that they are insensitive to waves and splashes, but sensitive enough that a swimmer need not exert undue pressure in order to activate the switch. Also, the swimmer must take care to touch the switch—if he touches the wall adjacent a switch, this touch pad switch will not record the touch. Furthermore, wires must be run from the touch pad switch to a timing and recording device. Moreover, this type of system would not be very beneficial during a training session, as it only records and displays a swimmer's total time for a preset number of laps, and gives no information about individual laps.

SUMMARY OF THE INVENTION

The present invention provides timing apparatus for swimmers which is well suited for use during training sessions, and overcomes many of the disadvantages of previously known timing systems for competitive swimmers.

The apparatus of the present invention is a device which utilizes a proximity-sensing means to count and time laps swum during a training session.

The device, which is preferably portable, comprises a housing, preferably in the form of a starting block of standard AAU dimensions. A switch means is provided in the device to detect when a swimmer leaves the device, and means are provided to input a predetermined number of laps for a training session.

A swimmer inputs the number of laps he wishes to swim, and stands on the starting block. When he begins the training session by leaving the block, the switch means activates a timing means. Each time he comes within a predetermined distance of the starting block, the proximity-sensing means, preferably an ultrasonic transducer, detects his presence, and a counter records the completion of a lap. A computing means records the time duration of the lap. When the swimmer completes his final lap, an alarm sounds, indicating the end of the training session. Display means indicate the total time duration of the training session, the number of laps completed during the session, the average time duration per lap, and the time duration of the fastest lap and the slowest lap.

The apparatus is a self-contained portable unit, which permits timing of the swimmer without auxiliary switches attached to the wall of the pool. The swimmer need do nothing differently from when he normally trains—he can concentrate on swimming, and not worry about trying to find a switch at the end of the swimming lane and trying to be sure to touch it with enough force to activate the switch.

It is an object of the present invention to provide a timing device for a swimmer which does not interfere with the swimmer's performance during a training session.

Another object of the present invention is to provide a timing device which employs a proximity-sensing device to detect the completion of each lap of a training session.

It is a further object of the present invention to provide a timing device which records and displays the number of laps completed during a training session, the time duration of the training session, the average lap time, the fastest lap time, and the slowest lap time.

Another object of the present invention is to provide a portable, self-contained timing device for swimmers which is free from auxiliary equipment and external wires.

A still further object of the present invention is to provide a timing device for use by swimmers in a training session which automatically signals the end of the training session.

BRIEF DESCRIPTION OF THE DRAWINGS

For a further understanding of the nature, objects and advantages of the present invention, reference should be had to the following detailed description, taken in conjunction with the accompanying drawings, in which like reference numerals denote like elements, and wherein.

DETAILED DESCRIPTION OF THE PREFERRED EMBODIMENT

Figure 2:
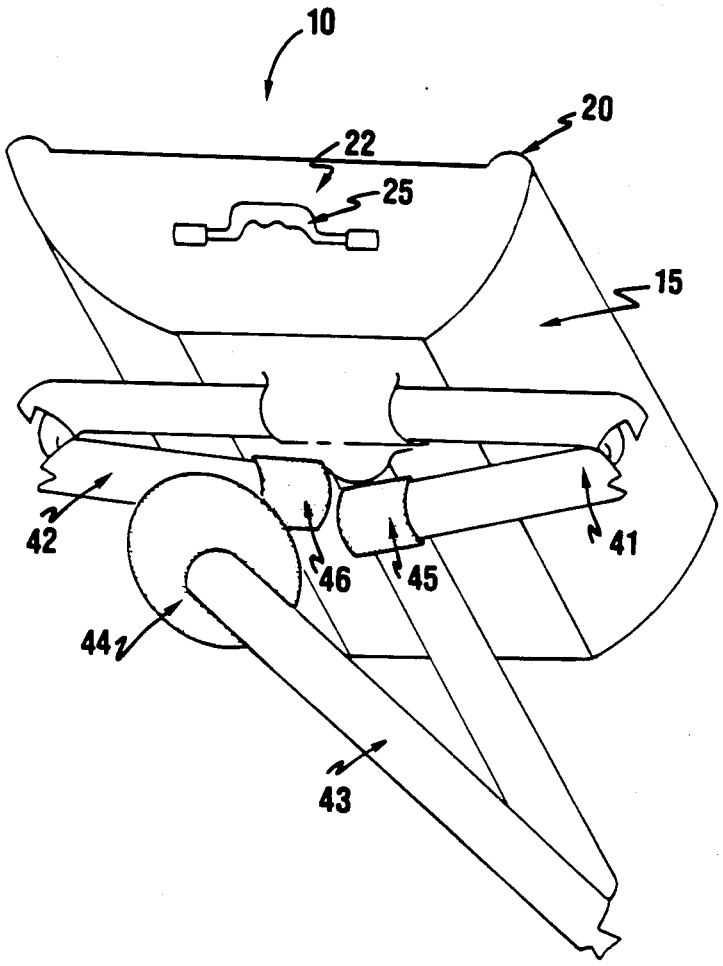
FIG. 2 is a perspective view of the apparatus shown in FIG. 1 with the legs in a folded position.
Figure 3:
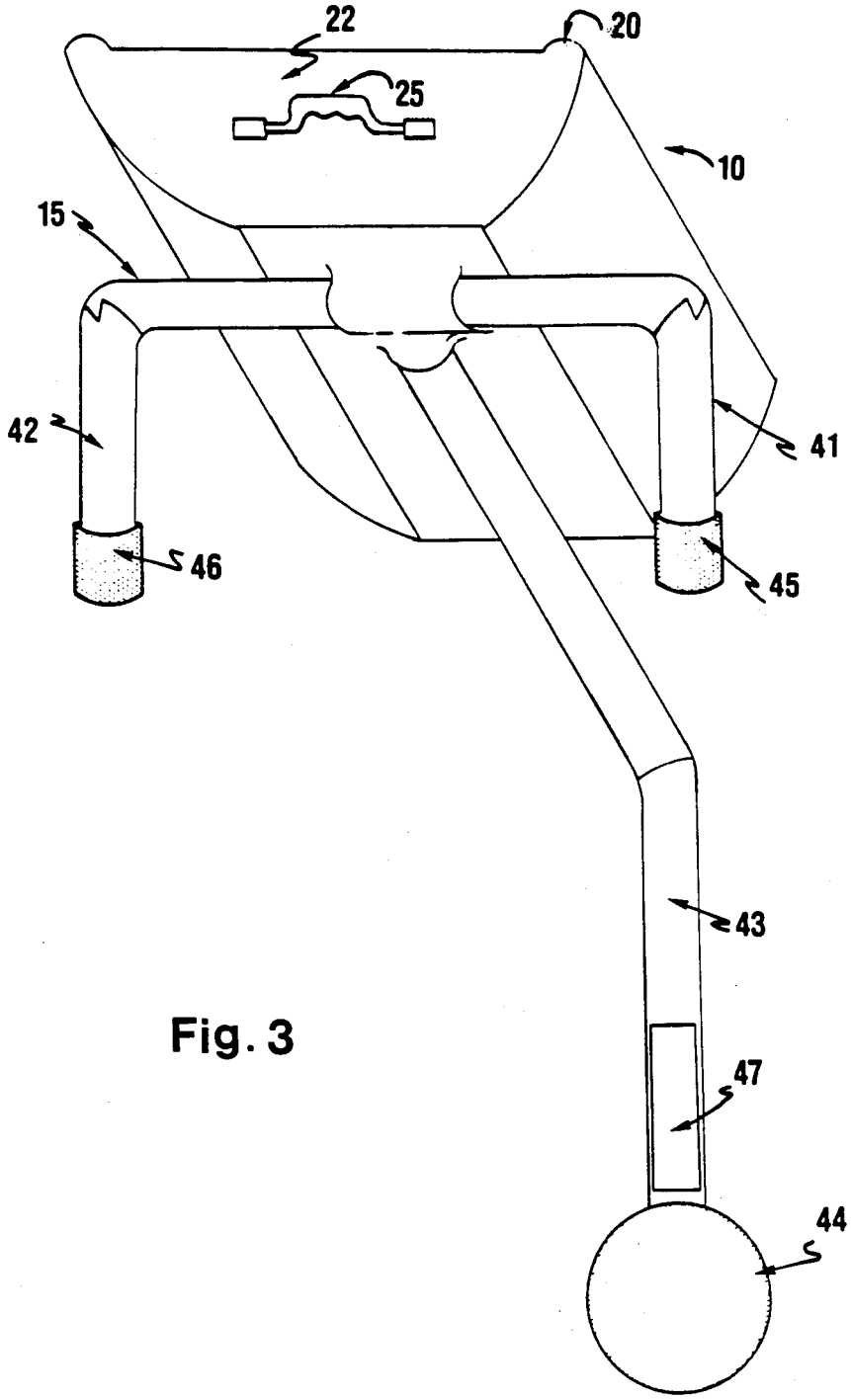
FIG. 3 is a perspective view of the apparatus shown in FIG. 1 with the legs in an unfolded position.

Referring now to the drawings, the preferred embodiment of the present invention, lap timing device 10, comprises a portable diving block 15 of standard AAU dimensions. Diving block 15 includes a housing 20 having a carrying handle 25 (FIGS. 2 and 3) on a back face 22 thereof. Housing 20 is supported by legs 41, 42 and 43 which are foldable (see FIG. 2) to ease transportation of lap timing device 10. Folding legs 41 and 42 have non-skid members 45 and 46, respectively, at lower ends thereof, preferably made of rubber. Folding leg 43 has an industrial grade suction cup 44 at its lower end to help secure it to a wall of a swimming pool, and a horizontal projection 47 to prevent downward movement of leg 43. Horizontal projection 47 is hingedly attached to leg 43, and can be folded against leg 43 when device 10 is not in use (as shown in FIG. 3). An upper surface of housing 20 comprises a diving platform 21 having a non-skid coating thereon. Housing 20 may be made of any suitably strong material, such as a reinforced polymer.

Input means 56 allow a swimmer to input a predetermined number of laps for a training session into lap timing device 10, and may comprise, for example, push buttons.

Figure 1:
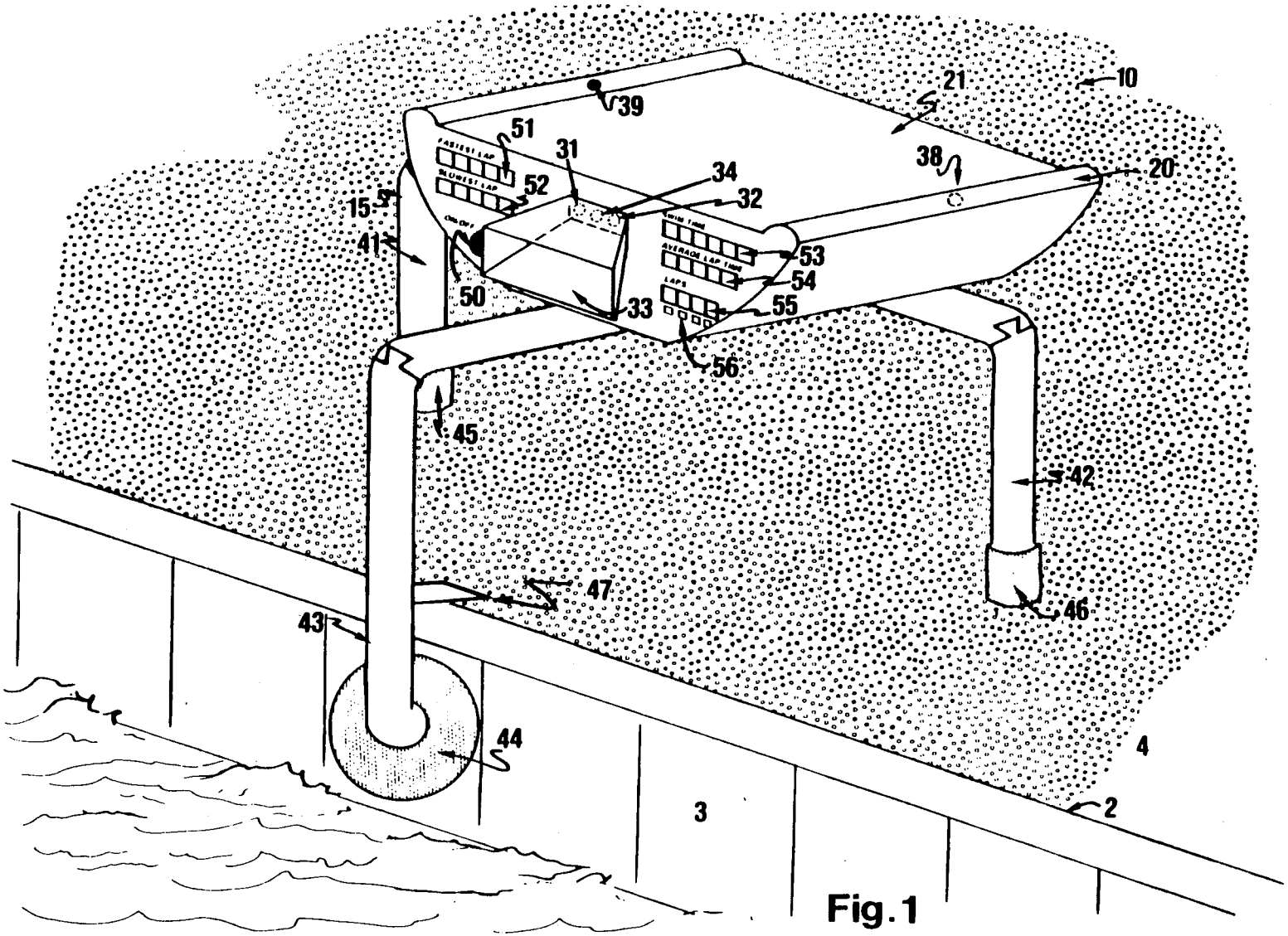
FIG. 1 is a perspective view of the preferred embodiment of the apparatus of the present invention mounted adjacent a swimming pool.

Starting switch means, preferably an optical switch means comprising a source of light 38 and a phototransistor 39 (FIG. 1) is provided adjacent diviing platform 21 to detect when a swimmer leaves diving platform 21.

An ultrasonic transducer means, comprising an ultrasonic transmitter 31 and an ultrasonic receivier 32, detects the completion of a lap by transmitting ultrasonic waves via ultrasonic transmitter 31 which are reflected by a swimmer and received by ultrasonic receiver 32 when the swimmer is within a predetermined distance from the lap timing device 10. The ultrasonic transducer utilizes air as the medium of transmission; the ultrasonic waves are absorbed by water, and are reflected back to ultrasonic receiver 32 only when they bounce off of parts of a swimmer's body which are above water.

A microprocessor 60 (see FIG. 4), contained within housing 20, receives information from input means 56, phototransistor 39, and ultrasonic receiver 32, and counts the number of laps a swimmer swims during the training session, determines the total swim time of the training session, the fastest lap time, the slowest lap time, the average time per lap, and determines when a predetermined number of laps has been swum.

Microprocessor 60 (FIG. 4) includes a read only memory (ROM) 62 which contains an operational program, a central processing unit (CPU) 61 for processing data, and a random access memory (RAM) 63 for storing data. The operational program, written into ROM 62 during assembly, instructs microprocessor 60 how to process data. The operational program provides a time delay when phototransistor 39 signals the beginning of a training session, and a time delay when the completion of a lap is detected by ultrasonic receive 32. These time delays are long enough to give a swimmer sufficient time to leave the range of the ultrasonic transducer, but not as long as the minimum time required to return to the range of the transducer after swimming to the other end of the pool. During these time delays, microprocessor 60 ignores any signals from ultrasonic receiver 32. Otherwise, if ultrasonic receiver 32 detected the presence of the swimmer as he dove into the water from diving platform 21, microprocessor 60 would consider that detection to signal the completion of a lap; likewise, the multiple detections by ultrasonic receiver 32 of the swimmer as he completed a lap and turned around would be considered the completion of a plurality of laps.

Liquid crystal digital (LCD) displays 51, 52, 53, 54 and 55 show fastest lap time, slowest lap time, total swim time, average lap time and total number of laps in a training session, respectively.

An alarm 34 sounds when a pedetermined number of laps has been swum during the training session.

A horn antenna 33 is provided to directionally limit the range of the ultrasonic transducer.

Figure 4:
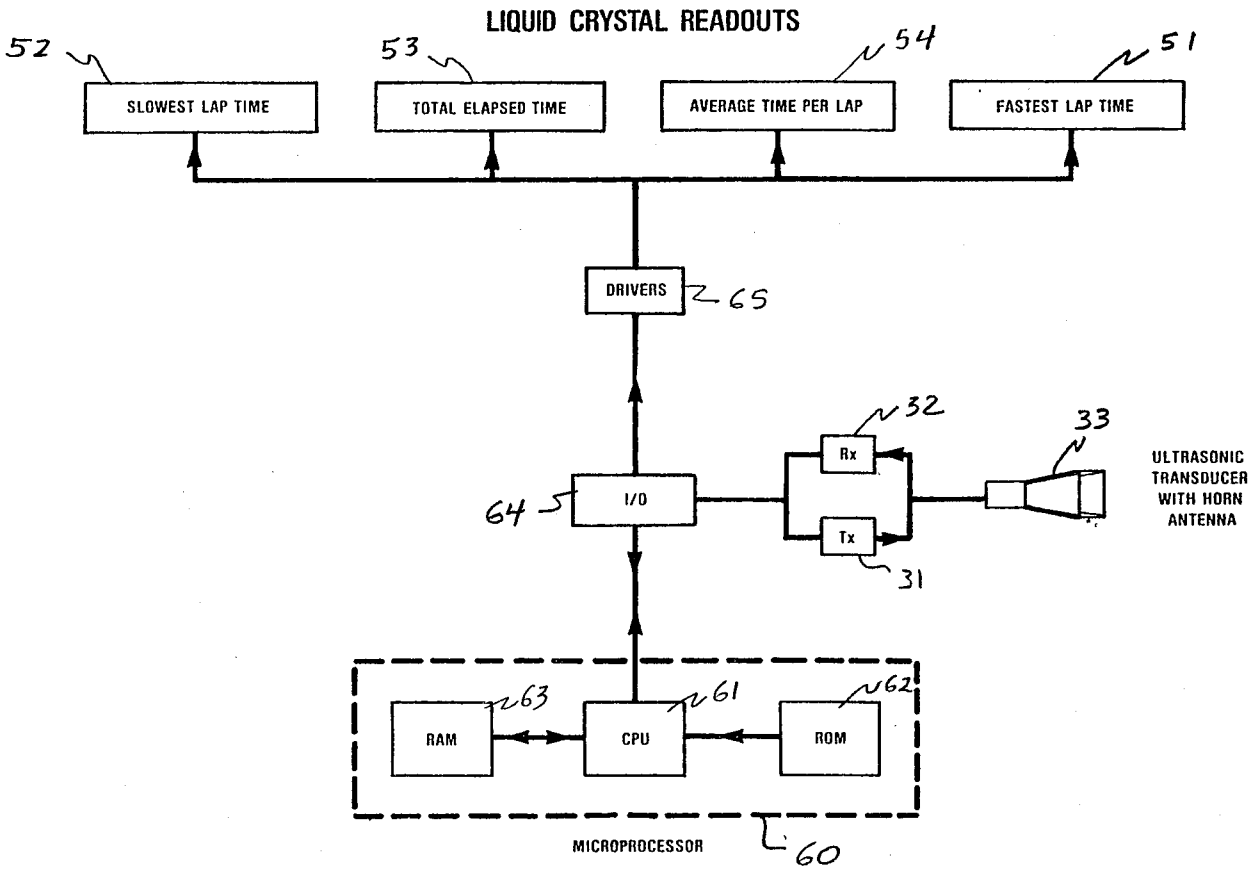
FIG. 4 is a schematic block diagram showing the interrelationship of electrical components of the present invention.

The block diagram shown in FIG. 4 schematically illustrates the interrelationship of various components of lap timing device 10. Power for the components preferably is in the form of a DC battery (not shown).

When a swimmer (not shown) is to begin a training session, folding legs 41, 42 and 43 are moved from a folded position (see FIG. 2) to an unfolded position (see FIG. 3). Lap timing device 10 is mounted adjacent an edge 2 of a swimming pool (FIG. 1) with suction cup 44 in contact with a wall 3 of the pool, and non-skid members 45 and 46 of legs 41 and 42, respectively, resting on a deck 4 surrounding the pool. Power switch 50 is turned on, and the number of laps which the swimmer wishes to swim during the training session is input into lap timing device 10 via input means 56, and are displayed in LCD display 55. The swimmer then stands on diving platform 21, interrupting optical communication between light source 38 and phototransistor 39. This causes microprocessor 60 to clear out all data stored to RAM 63, and the operational program causes microprocessor 60 to enter the "set" mode. When the swimmer dives off platform 21, light source 38 optically communicates with phototransistor 39, signaling microprocessor 60, via the operational program stored in ROM 62, to start a clock/counter (not shown). The time delay, provided for by the operational program, after the swimmer leaves platform 21, prevents microprocessor 60 from recording the completion of a lap if the swimmer's presence is detected by ultrasonic receiver 32 as he dives into the water. The swimmer swims to the opposite end of the pool and, in returning to the end adjacent the lap timing device 10, he approaches the range of the ultrasonic transducer. When the swimmer enters the range of the ultrasonic transducer, ultrasonic receiver 32 detects his presence, triggering an interrupt in the operational program, and the value of the clock/counter is stored in RAM 63. Microprocessor 60 ignores all subsequent detections by ultrasonic receiver 32 during the time delay provided for by the operational program. Each time the swimmer enters the range of the ultrasonic transducer, ultrasonic receiver 32 detects his presence, signaling the completion of a lap, and microprocessor 60 stores the values of the clock/counter in consecutive addresses of RAM 63. When the completion of the final lap is detected, alarm 34 sounds, signaling to the swimmer that the training session is over. The operational program stored in ROM 62 causes CPU 61 to determine the time duration of the fastest lap, the time duration of the slowest lap, the total time elapsed during the training session and the average time per lap, which values are transmitted via input/output circuitry 64 and drivers 65, to LCD displays 51, 52, 53 and 54, respectively.

It can thus be seen that the present invention provides a portable lap timing device which quickly and easily mounts adjacent an edge of a swimming pool, and which utilizes a proximity sensing means to detect the completion of laps during a training session. The proximity sensing means allows the device to be self-contained, eliminating the need for auxiliary wires and touch pads, greatly simplifying installation of the device.

Although a single preferred embodiment of the present invention has been shown and described, there are numerous modifications that could be made thereto. For example, a series of strain-guage resistors could be provided on top of the diving platform to act as a starting switch means, replacing the optical switch means. Also, the audio alarm could be replaced with a visual alarm, such as a strobe light, to accommodate deaf swimmers. Furthermore, the lap timing device could be made to fit onto standard concrete starting blocks, instead of being free-standing. In view of these and other modifications which could be made to the preferred embodiment without departing from the spirit or scope of the present invention, I pray that my rights to the present invention be limited only by the following claims.

I claim:

1. A lap timing device for swimmers for use during a training session, said device comprising:

a non-depressible means for detecting a beginning of a training session, said training session having a number of laps;

proximity sensing means for detecting an end of each lap of the training session;

means for measuring a time duration of the training session;

means for detecting an end of the training session; and means for indicating an average time duration per lap.

2. The device of claim 1, wherein said proximity sensing means comprises an ultrasonic transducer.

3. The device of claim 2, wherein said ultrasonic transducer utilizes air as a medium of transmission.

4. The device of claim 1, further comprising means to input a desired number of laps of the training session.

5. The device of claim 4, further comprising means for signaling the end of the training session.

6. The device of claim 5, wherein said means for signaling the end of the training session comprises an audible alarm.

7. The device of claim 1 further comprising:

means for displaying a time duration of a fastest lap of the training session; and means for displaying a time duration of a slowest lap of the training session.

8. The device of claim 1, wherein:

said lap timing device further comprises a diving platform; and said means for detecting the beginning of the training session comprises an optical switch means.

9. A portable lap timing device for use by a swimmer during a training session, said device comprising:

a diving platform;

means for inputting a desired number of laps of a training session;

a non-depressible starting switch means for detecting a beginning of the training session;

proximity sensing means for detecting an end of each lap of the training session;

means for determining a time duration of each lap;

means for detecting an end of the training session;

means for signaling the end of the training session;

means for determining a time duration of the training session;

means for determining an average time duration per lap;

means for indicating the time duration of the training session;

means for indicating the average time duration per lap;

means for displaying a time duration of a fastest lap; and means for displaying a time duration of a slowest lap.

10. The device of claim 9, wherein said proximity sensing means comprises an ultrasonic transducer.

11. The device of claim 10, wherein said ultrasonic transducer utilizes air as a medium of transmission.

12. The device of claim 9, wherein said means for signaling the end of the training session comprises an audio alarm.

13. The device of claim 9, wherein said starting switch means comprises an optical switch means.

14. The device of claim 9, further comprising means for displaying the number of laps of the training session.

15. A portable lap timing device for use by a swimmer during a training session, said device comprising:

a housing supported by foldable legs, said housing having a diving platform on an upper surface thereof;

means for inputting a desired number of laps of a training session;

a starting switch means for detecting a beginning of the training session;

proximity sensing means for detecting an end of each lap of the training session;

means for determining a time duration of each lap;

means for detecting an end of the training session;

means for signaling the end of the training session;

means for determining a time duration of the training session;

means for determining an average time duration per lap;

means for indicating the time duration of the training session;

means for indicating the average time duration per lap;

means for displaying a time duration of a fastest lap; and means for displaying a time duration of a slowest lap.

16. The portable lap timing device of claim 15, wherein two of said foldable legs are adapted for resting on a deck adjacent a swimming pool, and a third foldable leg comprises means for securing the third portable leg to a wall of a swimming pool.

17. A lap timing device for swimmers for use during a swimming session, said device comprising:

a diving platform mountable on a coping of a swimming pool;

a non-depressible means for detecting beginning of a swimming session, said swimming session having a number of laps;

means for detecting an end of the swimming session;

a proximity sensing means for detecting an end of each lap of the swimming session; and means for measuring a time duration of the swimming session.

* * * * *